US008530733B2

(12) United States Patent
Bibb

(10) Patent No.: US 8,530,733 B2
(45) Date of Patent: Sep. 10, 2013

(54) MUSICAL INSTRUMENT SUPPORT APPARATUS

(75) Inventor: Garrett Bibb, Marietta, GA (US)

(73) Assignee: Garrett Bibb, Marietta, GA (US)

( * ) Notice: Subject to any disclaimer, the term of this patent is extended or adjusted under 35 U.S.C. 154(b) by 111 days.

(21) Appl. No.: 13/155,841

(22) Filed: Jun. 8, 2011

(65) Prior Publication Data

US 2012/0312144 A1 Dec. 13, 2012

(51) Int. Cl.
*G10D 3/00* (2006.01)

(52) U.S. Cl.
USPC ..... 84/327

(58) Field of Classification Search
USPC ..... 84/411 R, 421, 327, 329
See application file for complete search history.

(56) References Cited

U.S. PATENT DOCUMENTS

2009/0188373 A1* 7/2009 May ..... 84/411 P
2012/0255422 A1* 10/2012 May ..... 84/421

* cited by examiner

*Primary Examiner* — Kimberly Lockett
(74) *Attorney, Agent, or Firm* — Turk IP Law, LLC

(57) ABSTRACT

A height adjustable music instrument support structure is used to secure a musical instrument while in a sitting position. A top is connected to base component using a nut and bolt mechanism. The height adjustment is lockable using a knob on the nut that latches to one of the notches on the bolt. The top is lined using soft material to prevent scratching of the musical instrument. The base is padded to enable comfortable user positioning.

18 Claims, 7 Drawing Sheets

MUSICAL INSTRUMENT SUPPORT APPARATUS

BACKGROUND

Music penetrates every aspect of modern life. Digitized media enable mobility as well as access during activities not previously convenient. Music players enable access to music throughout different venues in life. Entire libraries of music are transported along with a user in easy to carry mobile packages. The user has access to a variety of selections during activities such as jogging, parties, car travel and other venues. Device integration also has enabled a user to use a single device to carry music libraries. Technology has enabled users to use a multi-purpose device such as a smart phone to manage computational, conversational, and musical demands.

Improved access to music has led to increased demand for its production. Artists meet an ever increasing demand to produce music for variety of needs and venues. Increased demand on artistic production requires extensive periods of continued instrumentation use. Extensive periods of continued use can lead to discomfort due to requirements to hold an instrument in a precise position. Stresses caused by such continued concentration can lead to medical problems.

SUMMARY

This summary is provided to introduce a selection of concepts in a simplified form that are further described below in the Detailed Description. This summary is not intended to exclusively identify key features or essential features of the claimed subject matter, nor is it intended as an aid in determining the scope of the claimed subject matter.

Briefly, embodiments are directed to a device to hold a musical instrument in place while in a sitting position. The musical device support structure is made out of two major components. The base component a curved base for contact with a leg or similar support structure and a coupling to the top component. The top component has a groove structure to hold the musical instrument. The coupling between the top and base components may be in a variety of ways including a bolt/nut structure or similar joinders. According to another embodiment, the base component may be aligned to a user in a sitting position to secure the musical instrument. And, the musical instrument may be inserted into the groove structure of the top component.

These and other features and advantages will be apparent from a reading of the following detailed description and a review of the associated drawings. It is to be understood that both the foregoing general description and the following detailed description are explanatory and do not restrict aspects as claimed.

DETAILED DESCRIPTION

As briefly described above, a musical instrument support structure may aid to secure a musical instrument in place while in a sitting position. The musical device support structure is made out of two major components. The curved base connects to the top, which has a groove structure to hold the musical instrument. The connection may include a blot/nut mechanism, where the bolt may be slid into the nut to join the top and base components. According to another embodiment, the base may be aligned to a user in a sitting position to secure the musical instrument. And, the musical instrument may be inserted into the groove of the top component.

Figure 1:
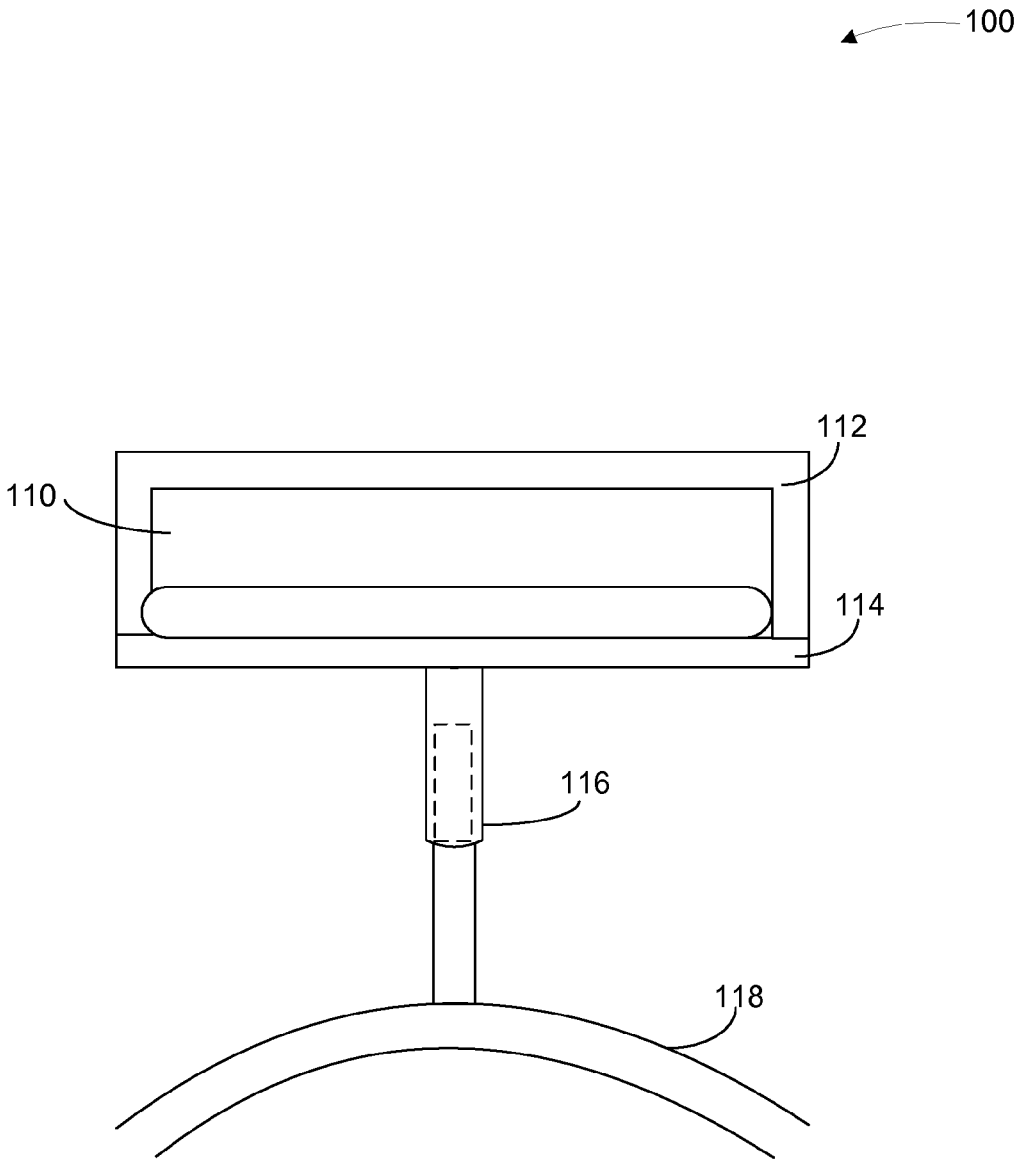
FIG. 1 illustrates the components of a musical instrument support structure.

FIG. 1 is a diagram illustrating the components of a musical instrument support structure. Diagram 100 shows the major components of the support structure and their assembly.

According to an embodiment, the base component is curved 118. An example embodiment may be a flat metal sheet having a longer length than the width. The base is curved 118 along the longer axis such as the axis along the length of the flat metal sheet. The base may be connected to a bolt 116. The bolt is inserted to a nut attached to the top component to join the base and the top components.

The top component may be made out of a metal sheet bent to a U shape to form a groove structure. Alternatively, the top component may be made out of multiple pieces. The music instrument holding portion may be made out of side walls 112 and bottom wall 114. The inside on the support structure may be lined with a soft cushion material 110 to prevent scratching the musical instrument. Side walls 112 may be adjustable to account for varying musical instrument widths.

Figure 2:
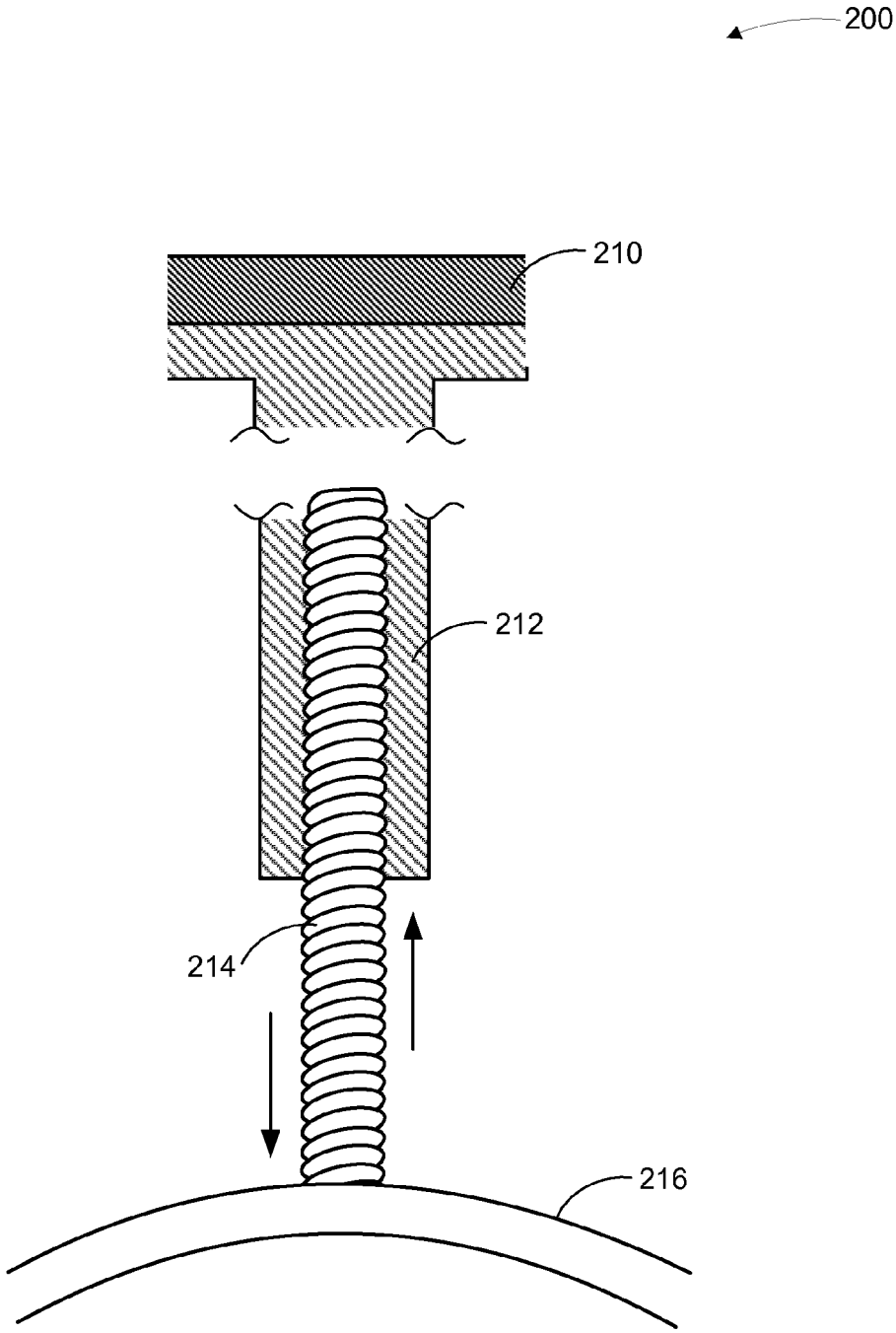
FIG. 2 illustrates an example bolt and nut mechanism of the musical instrument support structure.

FIG. 2 illustrates the bolt and nut mechanism of the musical instrument support structure. Diagram 200 shows a threaded bolt 214 protruding from the curved base 216. The bolt is inserted into the nut component 212 of the top. The top has an upper layer 210 made from different material than the lower layer to prevent scratching of the musical instrument. The nut element is similarly threaded as the bolt element in order to fit the bolt into the nut.

The height of the top component of the music instrument support structure may be adjusted up and down by twisting the top around the bolt. During manufacturing, the thread of the bolt may be made coarse to enable fast height adjustment. Alternatively, the thread of the bolt may be made fine during manufacture to enable slow and fine height adjustment.

In an alternative embodiment, instead of using a bolt and nut mechanism, the top and the base may be connected using a spring loaded slide mechanism. The slide mechanism tension may increase up or down during height adjustment of the top component. The top component may be locked in place using a knob that inserts into notches embedded in the slide mechanism. Other joining mechanisms may also be implemented using the principles described herein.

Figure 3:
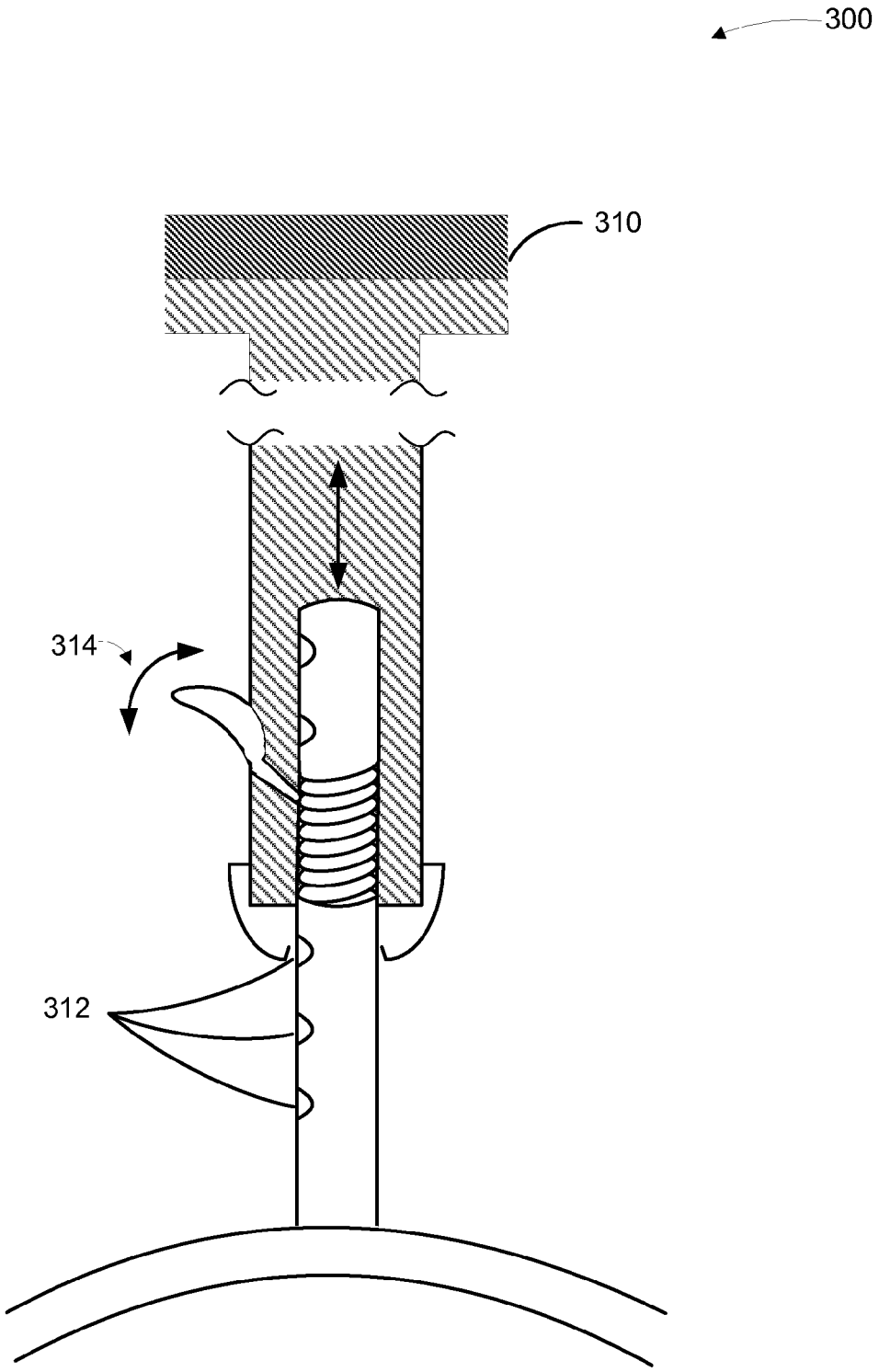
FIG. 3 illustrates an example height lock mechanism of the musical instrument support structure.

FIG. 3 illustrates an example height lock mechanism of the musical instrument support structure. Diagram 300 shows the height adjustable musical instrument with a locking mechanism to prevent further adjustment of the top component. During manufacture, the bolt component protruding out of the curved base may be made with notches 312 evenly divided along the bolt's height. A knob 314 attached to the nut component of the top 310 swings back and forward to insert into a notch on the bolt to prevent further movement of the top.

In an alternative embodiment, the notch may be spring loaded to remain in place by default while inserted into the notch. In another embodiment, there may only be two notches to allow locking at a low and high position.

Figure 4:
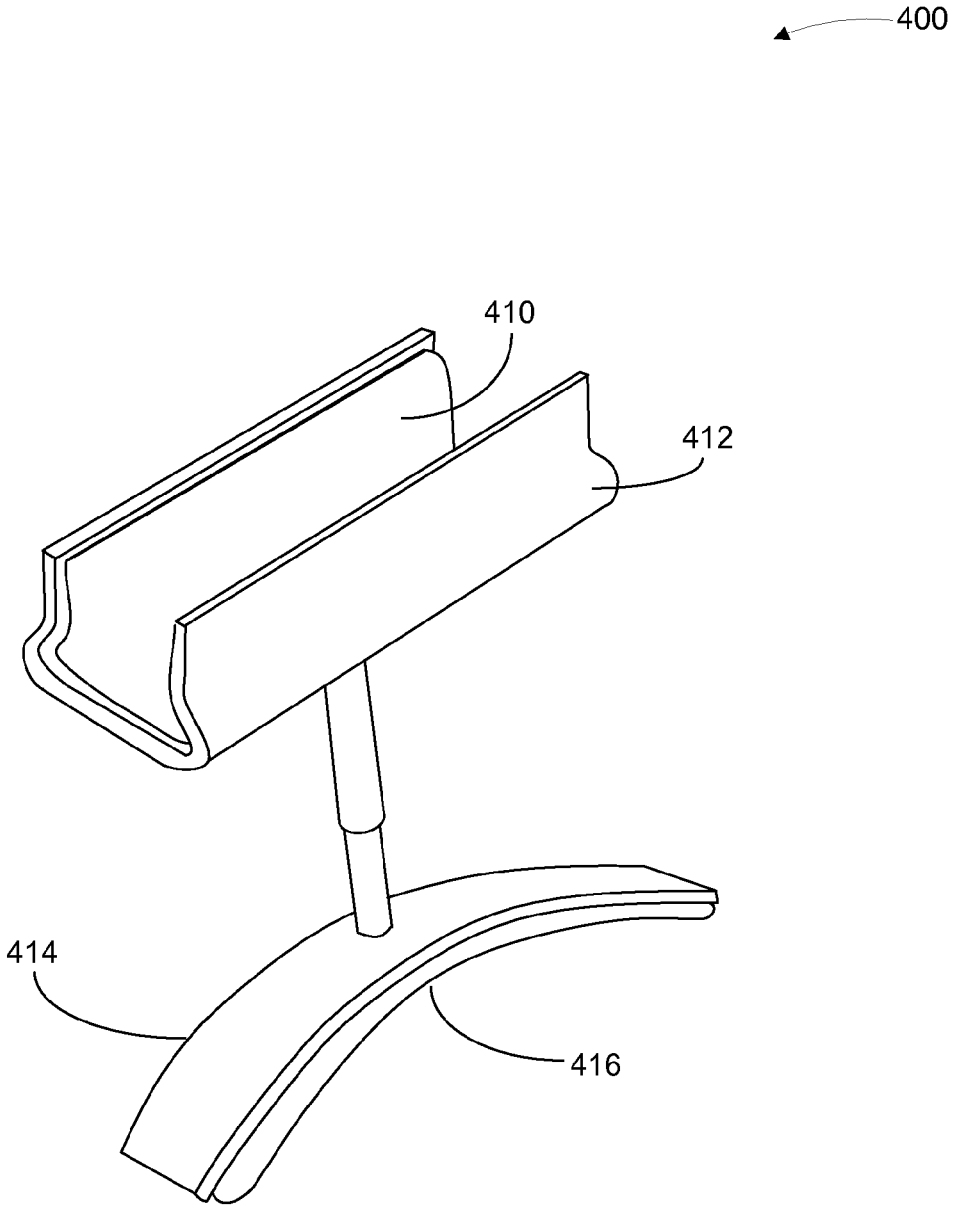
FIG. 4 illustrates details of a groove structure of the musical instrument support structure.

FIG. 4 illustrates details of a groove structure of the musical instrument support structure. Diagram 400 shows in detail the linings of the musical instrument support structure. In an embodiment the top 412 is lined with soft material 410. The soft material may be fabric, plastic, or similar soft material to prevent scratching of the musical instrument.

Base component 414 may also be lined with material 416. Material 416 is a padded material to help with user comfort. The padding may be of varying substances or adjustable heights to allocate for user preference. Alternatively, the padding may be removable and replaceable to allow for quick change of the padding to fit user preference.

Figure 5:
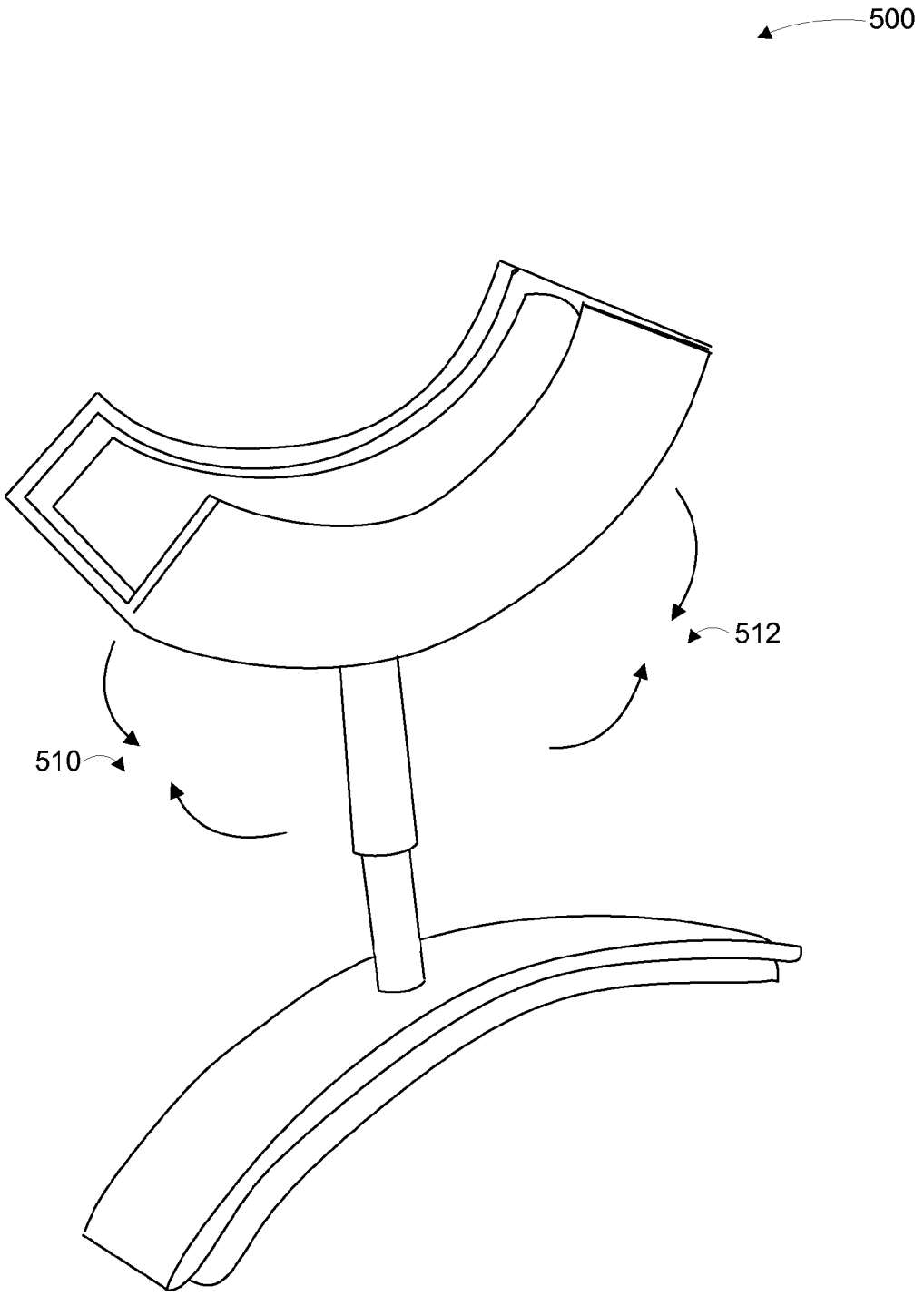
FIG. 5 illustrates example height adjustment mechanics of the musical instrument support structure.

FIG. 5 illustrates the height adjustment mechanics of the musical instrument support structure. Diagram 500 shows the musical instrument support structure in its entirety. A user may turn the top component by holding on one side 510 of the top component and turning the top clockwise or counterclockwise to adjust the height of the top component up or down. The height adjustment motion up or down in relation to the circular motion of the top will depend on thread pattern of the bolt and the nut.

Alternatively, the user may turn the top component by holding the top component on the other side 512 of the top component. Turning the top clockwise or counterclockwise adjusts the height up or down.

Figure 6:
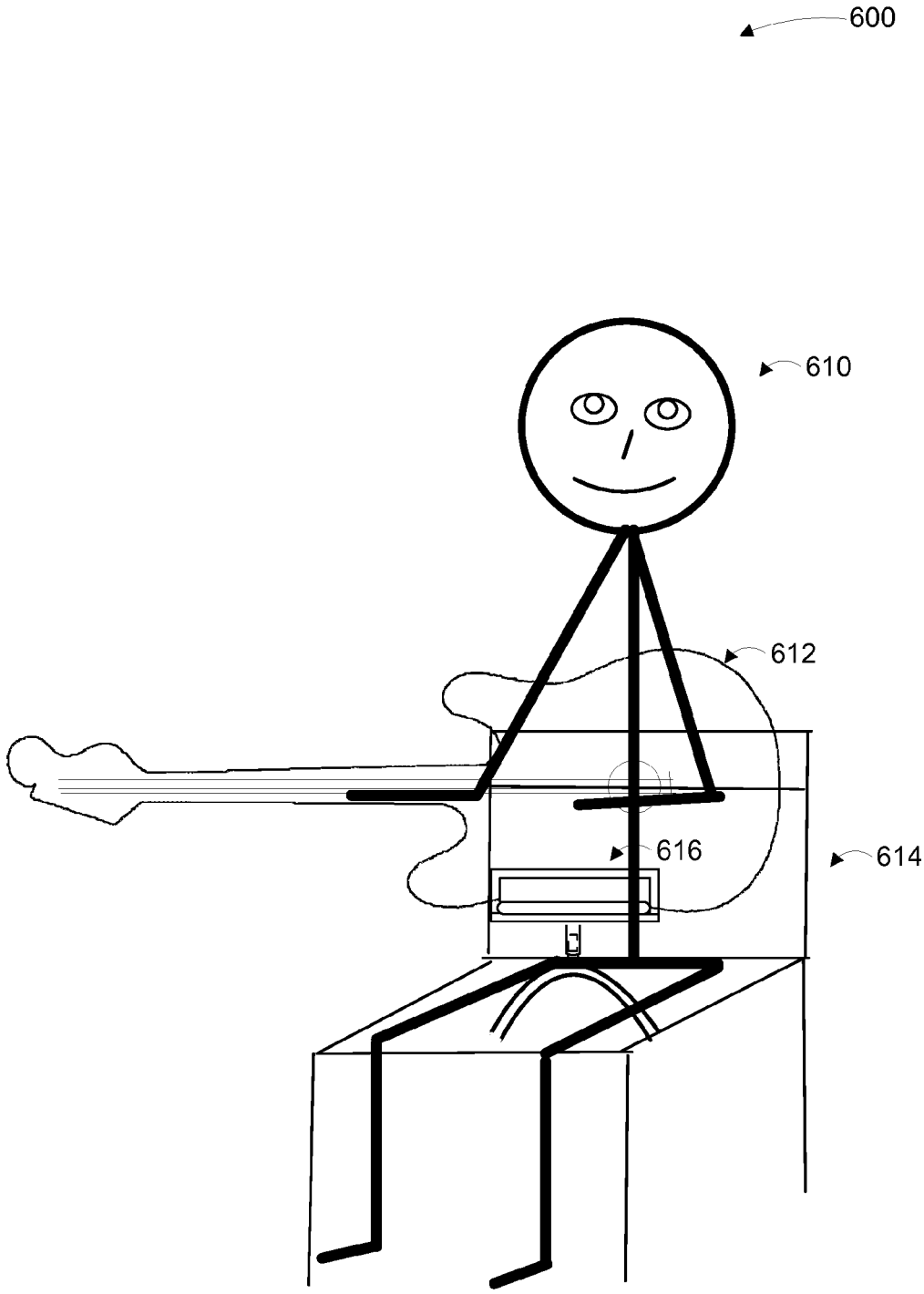
FIG. 6 illustrates an example embodiment of the musical instrument support structure.

FIG. 6 illustrates an example embodiment of the musical instrument support structure. Diagram 600 shows a user 610 sitting on a chair 614. The user may put the musical instrument support structure 616 on his lap. And, the user may insert the musical instrument 612 into the groove of the musical instrument support structure. In this orientation, the curved base of the musical instrument support structure sits on top of one of the user's legs.

Alternatively, the user may put the musical instrument in between the user's legs while aligning the bolt and nut elements to fit in between the legs. In this orientation, the curved base of the musical instrument support structure would be underneath the user's legs while the groove of the musical instrument support structure would be above the user's legs. The musical instrument may be a guitar, banjo, or similar instrument.

The assembly and implementation of the musical instrument support structure discussed above are for illustration purposes and do not constitute a limitation on embodiments. The musical support structure may be implemented using a bolt and nut mechanism. The bolt and nut mechanism may be lockable in place using notches and a knob. The musical instrument support structure while in a sitting position may be implemented employing other modules, processes, and configurations using the principles discussed herein.

Figure 7:
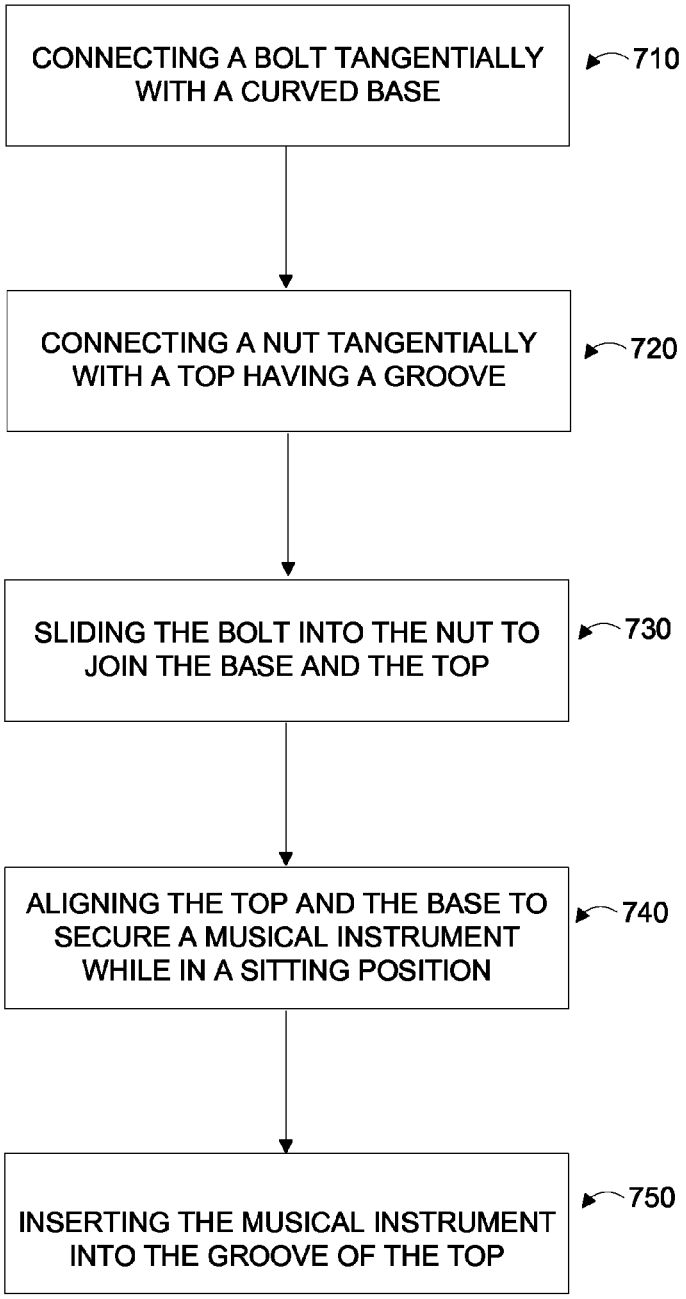
FIG. 7 illustrates a logic flow diagram for a process of assembling a musical instrument support structure while in a sitting position according to embodiments.

FIG. 7 illustrates a logic flow diagram for a process of assembling a musical instrument support structure while in a sitting position according to embodiments. Process 700 may be implemented by a user during assembly and use of the musical instrument support structure.

Process 700 begins with operation 710, where a bolt is connected tangentially with a curved base. The curved base may have an outer lining to enable comfortable positioning on top of the user's legs. At operation 720, a nut is connected tangentially with a top having a groove. The groove may be lined with material to prevent scratching of the musical instrument.

At operation 730, the bolt may be slid into the nut to join the base and the top. After assembling the components together, the user may align the base and the top to secure the musical instrument while in a sitting position at operation 740. The base and the top may be aligned in between the user's legs or alternatively, the musical instrument support structure may be put on top of the user's lap. The musical instrument may be inserted into the groove of the top at operation 750. The musical instrument may be a guitar. Alternatively, the musical instrument may be any musical instrument that may fit into the groove of the top component of the musical instrument support structure.

The above specification, examples and information provide a complete description of the manufacture and use of the composition of the embodiments. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and embodiments.

What is claimed is:

1. A method for assembling a musical instrument support structure, comprising:

coupling a curved base component with a top component having a groove structure, wherein the groove structure of the top component has two side walls and a bottom wall;

adjusting a height of the musical instrument support structure;

positioning the base component; and securing a musical instrument in the groove structure of the top component.

2. The method of claim 1, wherein the base component and the top component are coupled through a bolt/nut mechanism and the method further comprises:

connecting a bolt with the base component;

connecting a nut with the top component;

sliding the bolt into the nut to join the base and top components;

adjusting the height of the musical instrument support structure by turning the bolt inside the nut; and securing a desired position of the bolt/nut mechanism.

3. The method of claim 2, further comprising:

adjusting the height of the musical instrument support structure by turning one of the bolt and the nut clockwise or counterclockwise.

4. The method of claim 2, wherein the bolt and the nut have a coarse thread to enable fast height adjustment.

5. The method of claim 2, wherein the bolt and the nut have a fine thread to enable slow and fine height adjustment.

6. The method of claim 1, wherein an inside of the groove structure of the top component is lined with a soft material to prevent scratching of the musical instrument.

7. The method of claim 1, wherein a bottom surface of the curved the base component is lined with a padding material.

8. The method of claim 5, wherein padding material is removable.

9. The method of claim 5, wherein padding material has adjustable heights to allocate for a user's comfort.

10. The method of claim 1, wherein the groove structure of the top component is formed in a U-shape.

11. The method of claim 1, wherein the two side walls are adjustable to account for different musical instrument widths.

12. A musical instrument support structure, comprising:

a curved base component for providing support when a user holding a musical instrument is in a sitting position;

a top component with a groove structure for holding the musical instrument; and a coupling mechanism for connecting the base and top components with adjustable height, wherein the coupling mechanism includes a bolt/nut joinder.

13. The musical instrument support structure of claim 12, wherein the bolt/nut joinder includes a locking mechanism.

14. The musical instrument support structure of claim 12, wherein the locking mechanism comprises a plurality of notches distributed along a height of the bolt and a knob to be inserted into one of the notches.

15. The musical instrument support structure claim 12, wherein the locking mechanism comprises two notches along a height of the bolt and a knob to be inserted into one of the notches for one of a high position and a low position.

16. The musical instrument support structure of claim 12, wherein the bolt/nut joinder includes a spring loaded mechanism.

17. A method for manufacturing a musical instrument support structure, comprising:

forming a curved base component for providing support when a user of a musical instrument is in a sitting position and a top component having a groove structure for holding the musical instrument, wherein the groove structure of the top component has two side walls and a bottom wall;

lining an inside surface of the groove structure and a bottom surface of the base component with a padding material; and coupling the base component with the top component through a height adjustable and lockable connection mechanism, wherein the connection mechanism includes a bolt/nut joinder.

18. The method of claim 17, wherein the bolt/nut joinder includes a coarse thread to enable fast height adjustment and a fine thread to enable slow and fine height adjustment.

* * * * *